US009881557B2

(12) United States Patent
Back et al.

(10) Patent No.: US 9,881,557 B2
(45) Date of Patent: Jan. 30, 2018

(54) DISPLAY DEVICE AND CONTROL DEVICE

(71) Applicant: LG Display Co., Ltd., Seoul (KR)

(72) Inventors: Hyunchul Back, Nam-gu (KR); Jihun Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 83 days.

(21) Appl. No.: 14/880,747

(22) Filed: Oct. 12, 2015

(65) Prior Publication Data

US 2016/0117974 A1 Apr. 28, 2016

(30) Foreign Application Priority Data

Oct. 22, 2014 (KR) ..... 10-2014-0143633

(51) Int. Cl.

*G09G 3/20* (2006.01)
*G09G 3/3275* (2016.01)
*G09G 3/3225* (2016.01)

(52) U.S. Cl.

CPC ..... *G09G 3/3275* (2013.01); *G09G 3/3225* (2013.01); *G09G 2300/0452* (2013.01); *G09G 2310/027* (2013.01); *G09G 2320/0285* (2013.01); *G09G 2320/0295* (2013.01); *G09G 2320/045* (2013.01)

(58) Field of Classification Search

CPC ..... G09G 3/3275; G09G 3/3225; G09G 2300/0452; G09G 2310/027; G09G 2320/0285; G09G 2320/0295; G09G 2320/045

See application file for complete search history.

(56) References Cited

U.S. PATENT DOCUMENTS 7,050,705 B1 * 5/2006 Mori ..... H04N 5/76 386/235
2005/0140599 A1 * 6/2005 Lee ..... G09G 3/3233 345/76

(Continued)

FOREIGN PATENT DOCUMENTS

CN 101320179 A 12/2008
CN 102074189 A 5/2011
CN 102750903 A 10/2012

OTHER PUBLICATIONS

Chinese First Office Action, Chinese Application No. 201510686355.5, dated Oct. 16, 2017, 14 pages.

*Primary Examiner* — Sejoon Ahn
(74) *Attorney, Agent, or Firm* — Fenwick & West LLP

(57) ABSTRACT

The present invention provides a display device comprising: a display panel including data lines, gate lines, a sub-pixel formed in every point where the gate lines and the data lines cross, and a sensing line formed in every sub-pixel row or every two or more sub-pixel rows, the sensing line being connected to a circuit in the sub-pixel row; a data driving unit that provides a data voltage to the data lines; an Analog Digital Converter (ADC) that converts a sensing voltage measured through a sensing channel corresponding to each sensing line into sensing data of a digital type; and a timing controller that controls the data driving unit, and performs a pixel compensation which changes data provided to a corresponding sub-pixel based on the sensing data, and when the sensing data is abnormal, changes the data provided to the corresponding sub-pixel based on previous sensing data.

10 Claims, 18 Drawing Sheets

(56) References Cited

U.S. PATENT DOCUMENTS

2006/0022305 A1* 2/2006 Yamashita ..... G09G 3/2014 257/565
2007/0008250 A1* 1/2007 Hoppenbrouwers ..... G09G 3/3225 345/76
2007/0115244 A1* 5/2007 Shin ..... G09G 3/3266 345/100
2009/0140959 A1* 6/2009 Nam ..... G09G 3/3233 345/76
2009/0309818 A1* 12/2009 Kim ..... G09G 3/3233 345/77
2011/0057919 A1* 3/2011 Kim ..... G09G 3/3233 345/211
2011/0084955 A1* 4/2011 Kim ..... G09G 3/3283 345/212
2014/0168039 A1* 6/2014 Kim ..... G09G 3/3208 345/82
2014/0294090 A1* 10/2014 Chen ..... H04N 19/51 375/240.24
2014/0347401 A1* 11/2014 Hwang ..... G09G 3/3233 345/690
2015/0324981 A1* 11/2015 Kim ..... A61N 5/0618 345/619

* cited by examiner

FIG. 11B

400

| |
|---|
| OFF_RS 1<br>~~(OFF_RS SENSING DATA)~~ |
| OFF_RS 2<br>~~(RECENT OFF_RS SENSING DATA)~~ |
| Comp |
| RT_ref |

FIG. 11C

400

| |
|---|
| OFF_RS 1<br>~~(RECENT OFF_RS SENSING DATA)~~ |
| OFF_RS 2<br>~~(OFF_RS SENSING DATA)~~ |
| Comp<br>~~(OFF_RS SENSING DATA)~~ |
| RT_ref |

DISPLAY DEVICE AND CONTROL DEVICE

CROSS-REFERENCE TO RELATED APPLICATIONS

This application claims priority from and the benefit under 35 U.S.C. §119(a) of Korean Patent Application No. 10-2014-0143633, filed on Oct. 22, 2014, which is hereby incorporated by reference for all purposes as if fully set forth herein.

BACKGROUND

1. Field of the invention

The present invention relates to a display device displaying an image.

2. Description of the Related Art

As the information society develops, display devices for displaying an image are being increasingly required in various forms, and in recent years, various display devices such as Liquid Crystal Displays (LCDs), Plasma Display Panels (PDPs), and Organic Light Emitting Diode (OLED) display devices have been utilized.

The display device includes a display panel, a data driving unit and a gate driving unit. The display panel includes data lines and gate lines, and pixels are defined at each point where the data lines and the gate lines intersect. The data driving unit provides data signals to the data lines. The gate driving unit provides scan signals to the gate lines.

A transistor is disposed in each sub-pixel defined in the display panel. Characteristic values of the transistors in each sub-pixel may be changed, or a deviation of the characteristic values of the transistors in each sub-pixel may be generated. Also, when the display device is the OLED display device, a deviation of a degradation of an OLED in each sub-pixel may be generated. Such a phenomenon may generate a luminance non-uniformity between sub-pixels and may degrade display quality Thus, in order to resolve the luminance non-uniformity between the sub-pixels, a pixel compensation technique for compensating a characteristic value change or a characteristic value deviation of an element (e.g., a thin film transistor and an OLED) in a circuit is proposed.

The pixel compensation technique is a technique which senses a specific node of a circuit in the sub-pixel, changes data provided to each sub-pixel using a result of the sensing, and thus prevents or reduces the luminance non-uniformity of the sub-pixels.

Although the pixel compensation technique according to the prior art is being provided, a phenomenon in which the luminance compensation of the sub-pixel or the luminance deviation compensation between the sub-pixels is not performed is still generated.

SUMMARY

In this background, an aspect of the present invention is to provide a technique which provides a pixel compensation function and compensates data based on previous sensing data when a pixel compensation is failed.

In accordance with an aspect of the present invention, a display device comprises: a display panel including data lines, gate lines, a sub-pixel formed in every point where the gate lines and the data lines cross, and a sensing line formed in every sub-pixel row or every two or more sub-pixel rows, the sensing line being connected to a circuit in the sub-pixel row; a data driving unit that provides a data voltage to the data lines; an Analog Digital Converter (ADC) that converts a sensing voltage measured through a sensing channel corresponding to each sensing line into sensing data of a digital type; and a timing controller that controls the data driving unit, and performs a pixel compensation which changes data provided to a corresponding sub-pixel based on the sensing data, and when the sensing data is abnormal, changes the data provided to the corresponding sub-pixel based on previous sensing data.

In accordance with another aspect of the present invention, a control device comprises: a timing controller that controls a data driving unit, and performs a pixel compensation which changes data provided to a corresponding sub-pixel based on sensing data, and when the sensing data is abnormal, changes the data provided to the corresponding sub-pixel based on previous sensing data; and a memory that stores the sensing data.

As described above, according to the present invention, a pixel compensation function can be provided and data can be compensated based on previous sensing data when a pixel compensation is failed.

BRIEF DESCRIPTION OF THE DRAWINGS

The above and other objects, features and advantages of the present invention will be more apparent from the following detailed description taken in conjunction with the accompanying drawings, in which:

FIGS. 11A to 11D illustrate a memory according to another embodiment.

DETAILED DESCRIPTION

Figure 1:
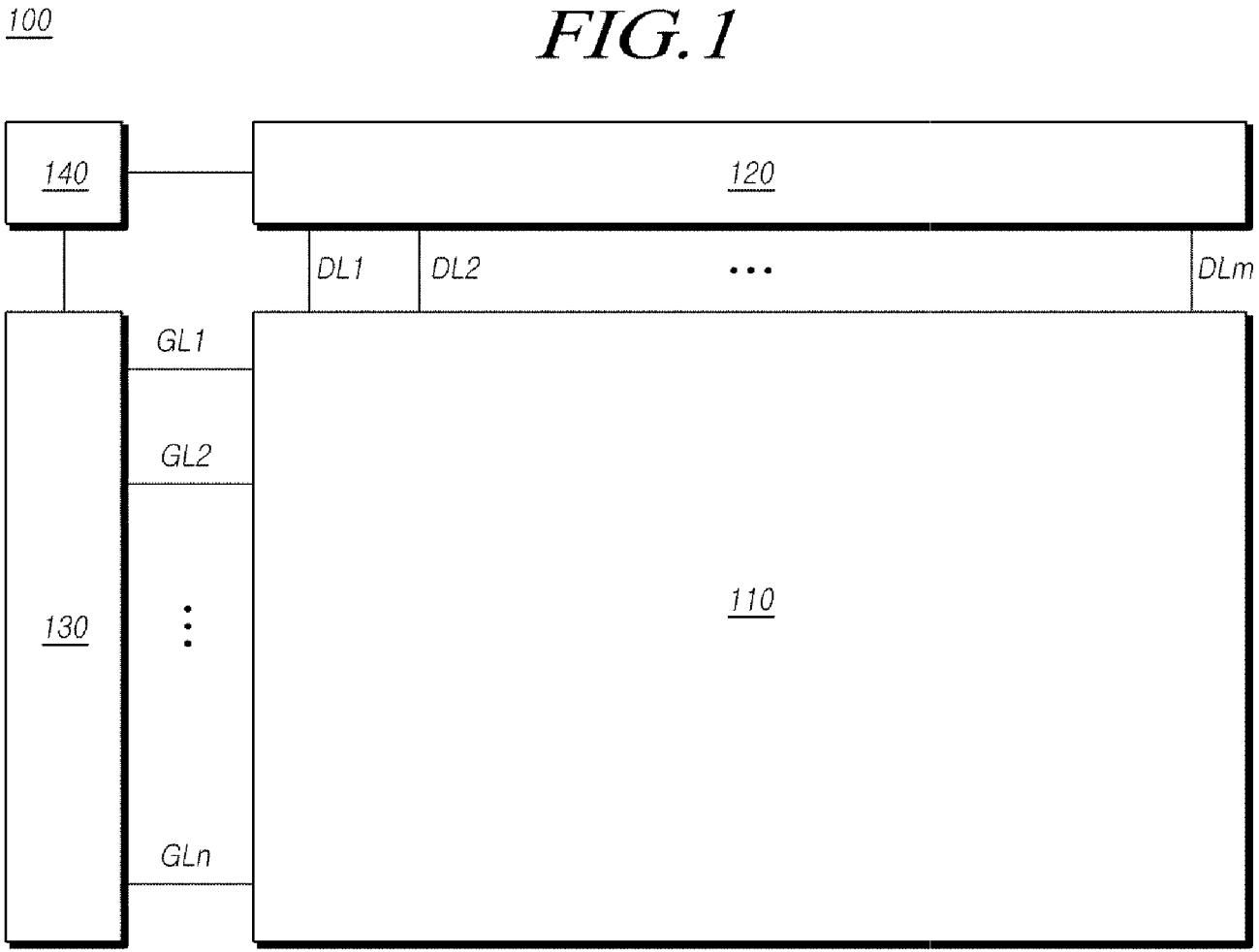
FIG. 1 is a schematic system configuration view of a display device according to an embodiment.

Hereinafter, embodiments of the present invention will be described with reference to the accompanying drawings. In designating elements of the drawings by reference numerals, the same elements will be designated by the same reference numerals although they are shown in different drawings. Further, in the following description of the present invention, a detailed description of known functions and configurations incorporated herein will be omitted when it may make the subject matter of the present invention rather unclear.

In addition, terms, such as first, second, A, B, (a), (b) or the like may be used herein when describing components of the present invention. Each of these terminologies is not used to define an essence, order or sequence of a corresponding component but used merely to distinguish the corresponding component from other component(s). In the case that it is described that a certain structural element "is connected to", "is coupled to", or "is in contact with" another structural element, it should be interpreted that another structural element may "be connected to", "be coupled to", or "be in contact with" the structural elements as well as that the certain structural element is directly connected to or is in direct contact with another structural element.

FIG. 1 is a schematic system configuration view of a display device 100 according to an embodiment.

Referring to FIG. 1, the display device 100 according to an embodiment includes a display panel 110, a data driving unit 120, a gate driving unit 130, a timing controller 140 and the like.

In the display panel 110, data lines DL1, DL2, . . . , and DLm and gate lines GL1, GL2, . . . , and GLn are formed, and a Sub-pixel (SP) is formed in every point where the data lines DL1, DL2, . . . , and DLm and the gate lines GL1, GL2, . . . , and GLn intersect.

The data driving unit 120 provides a data voltage to the data lines.

The data driving unit 120 includes two or more Data driving Integrated Circuits (DICs) 200.

The gate driving unit 130 sequentially provides a scan signal to the gate lines.

The timing controller 140 controls the data driving unit 120 and the gate driving unit 130.

Meanwhile, in the sub-pixel formed in the display panel 110, a circuit including at least one transistor is configured.

Here, the circuit in the sub-pixel may further include at least one capacitor and Organic Light Emitting Diode (OLED) according to a circuit design method, a display device type, and the like, in addition to at least one transistor.

The display device 100 according to an embodiment may provide a pixel compensation function. The pixel compensation function is for compensating a luminance deviation between the sub-pixels, which is generated according to a change or a deviation of a characteristic (e.g., a threshold voltage, mobility and the like) of the transistor in the circuit of the sub-pixel.

The display device 100 according to the embodiment needs a configuration for sensing the characteristic value of the transistor in the circuit of the sub-pixel in order to provide the pixel compensation function.

Thus, in the display panel 110, a Sensing Line (SL) connected to the circuit in the sub-pixel may be formed in every one or more sub pixel rows.

For example, in a case of a shared structure in which one sensing line exists in every two or more sub-pixel rows, one sensing line may exist in every three sub-pixel rows (e.g., a red sub-pixel row, a green sub-pixel row and a blue sub-pixel row).

That is, when one pixel includes three sub-pixels (i.e., a red sub-pixel, a green sub-pixel and a blue sub-pixel), one sensing line may exist in every pixel row.

Alternatively, one sensing line may exist in every four sub-pixel rows (e.g., a red sub-pixel row, a white sub-pixel row, a green sub-pixel row and a blue sub-pixel row). That is, when one pixel includes four sub-pixels (i.e., a red sub-pixel, a white sub-pixel, a green sub-pixel and a blue sub-pixel), one sensing line may exist in every pixel row.

Meanwhile, in order to provide the pixel compensation function, the display device 100 according to an embodiment may further include a sensing unit and a pixel compensation unit in addition to the sensing line. The sensing unit converts a sensing voltage Vsen measured through each sensing line SL into a sensing data Desn of a digital type. The pixel compensation unit changes data provided to the sub-pixel based on the sensing data which is sensed by the sensing unit and is output from the sensing unit, to compensate a pixel.

Hereinafter, the above-mentioned sensing unit is referred to as an Analog Digital Converter (ADC).

The ADC may be placed in any position of the display device 100, but the ADC is included in the data driving integrated circuit as an embodiment in the present specification and drawings.

In addition, the above-mentioned pixel compensation unit may be placed in any position of the display device 100, but the pixel compensation unit is included in the timing controller 140 as an embodiment in the present specification and drawings.

Figure 2:
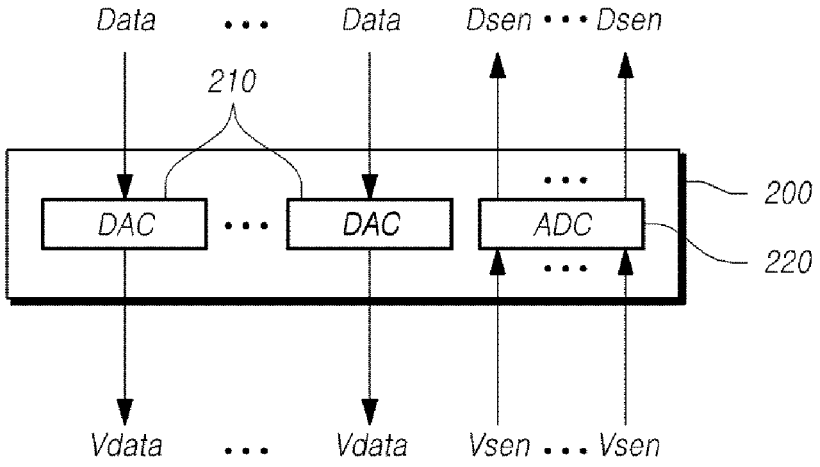
FIG. 2 is a view schematically illustrating a data driving integrated circuit of a data driving unit in the display device according to an embodiment.

FIG. 2 is a view schematically illustrating the data driving integrated circuit 200 of the data driving unit 120 in the display device 100 according to an embodiment.

Referring to FIG. 2, each data driving circuit 200 includes a driving configuration for providing a data voltage Vdata to a plurality of corresponding sub-pixels, and a sensing configuration for the plurality of corresponding sub-pixels.

Referring to FIG. 2, the driving configuration includes a Digital Analog Converter (DAC) 210 which converts data Data input from the timing controller 140 to the data voltage Vdata of the analog type.

Referring to FIG. 2, the sensing configuration may include an ADC 220. The ADC 220 senses the voltage Vsen of a sensing node in the circuit of the plurality of corresponding sub-pixels through two or more sensing lines (of which concept may be equal to that of sensing channels), converts the voltage Vsen to the sensing data Dsen of a digital type, and outputs the sensing data Dsen.

As shown in FIG. 2, one ADC 220 is included in one data driving integrated circuit 200. Thus, if two or more data driving integrated circuits 200 are in the display device 100, two or more ADCs 220 are also included in the display device 100.

One ADC 220 included in one data driving integrated circuit 200 is connected to two or more sensing lines SL, and senses the voltage Vsen through each sensing line.

Here, one sensing line GL connects the ADC 220 with one or more sub-pixel rows. That is, each of two or more sensing lines connected to one ADC 220 may be a line sensing the voltage of the sensing node of the circuit in one sub-pixel, but in the case of the shared structure, each of two or more sensing lines connected to one ADC 220 may be a line simultaneously or sequentially sensing the voltage of the sensing node of the circuit in two or more sub-pixels.

The ADC 220 included in one data driving integrated circuit 200 converts the sensing voltage Vsen which is measured through sensing channels respectively corresponding to two or more sensing lines into the sensing data Vsen of a digital type.

Figure 3:
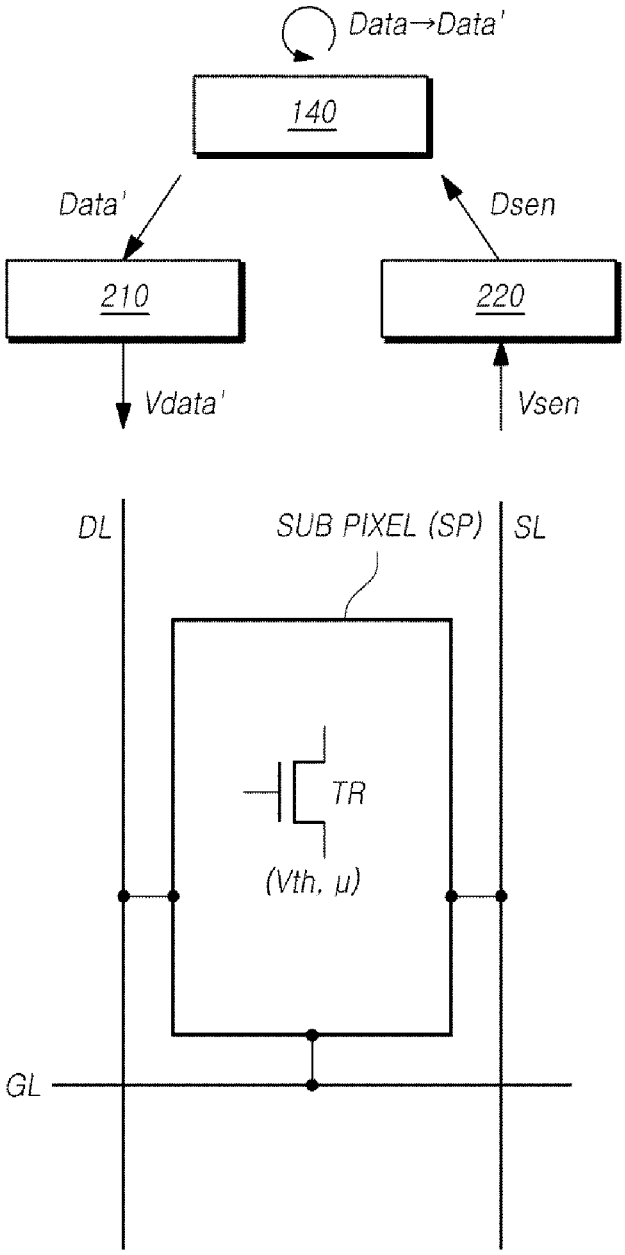
FIGS. 3 and 4 are diagrams illustrating pixel compensation of the display device according to an embodiment.

FIG. 3 is a diagram illustrating a pixel compensation of the display device 100 according to an embodiment.

Referring to FIG. 3, the ADC 220 in the data driving integrated circuit 200 sense the voltage Vsen of the sensing node (e.g., a source or drain node of the transistor) in a circuit of the sub-pixel SP through the sensing line SL connected to the circuit in the sub-pixel SP, converts the voltage Vsen into the sensing data Dsen of the digital type, and outputs the sensing data Dsen.

The timing controller 140 changes the data Data provided to a corresponding sub-pixel SP and outputs the changed data Data', in order to compensate a characteristic value (e.g., a threshold voltage (Vth), a mobility (μ) and the like) of the transistor TR in the sub-pixel SP, using the sensing data Dsen. Thus, the DAC 210 in the data driving integrated circuit 220 converts the changed data Data' into a data voltage Vdata' and outputs the data voltage Vdata'.

Therefore, the corresponding pixel SP receives the data voltage Vdata' capable of compensating the characteristic value of the transistor TR, and a luminance non-uniformity of the corresponding sub-pixel SP may be prevented or reduced.

The pixel compensation which is schematically described with reference to FIG. 3 is described in more detail with reference to FIGS. 4 and 5.

Figure 4:
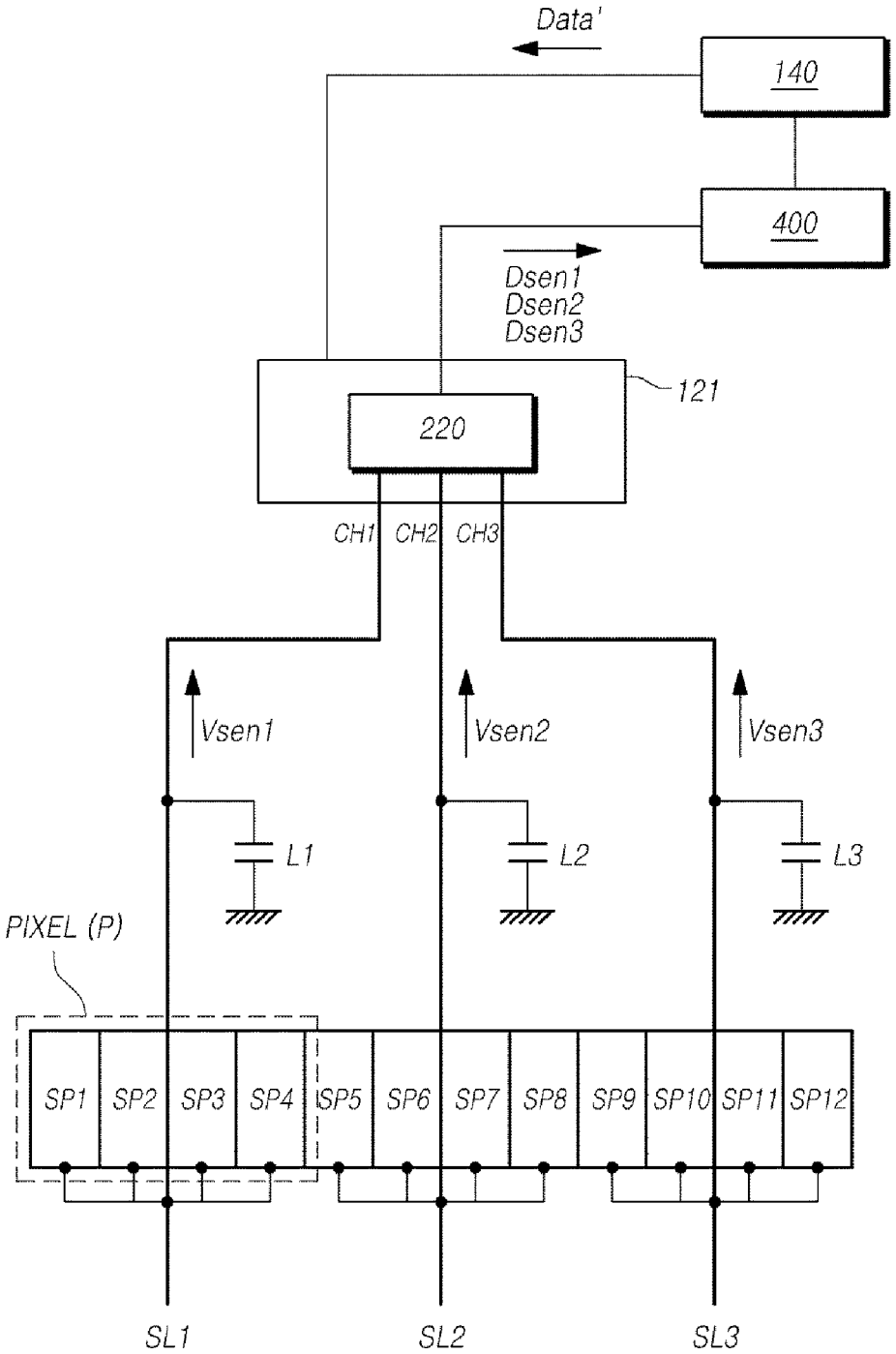

FIG. 4 is a view for describing a pixel compensation of the display device 100 according to an embodiment. FIG. 5 is a diagram illustrating sensing and converting functions of the ADC 220 in the display device 100 according to an embodiment.

In an example of FIG. 4, one ADC 220 has three sensing channels CH1, CH2 and CH3. The three sensing channels CH1, CH2 and CH3 are connected to three sensing lines SL1, SL2 and SL3, respectively. Each of three sensing lines SL1, SL2 and SL3 is connected to four sub-pixels SP. The four sub-pixels SP may form one pixel P. For example, the four sub-pixels SP may include a red sub-pixel, a white sub-pixel, a green sub-pixel and a blue sub-pixel.

Referring to FIG. 4, the ADC 220 may sense the voltage Vsen of the sensing node in one sub-pixel SP, through each sensing line SL1, SL2 and SL3 at one time.

Figure 5:
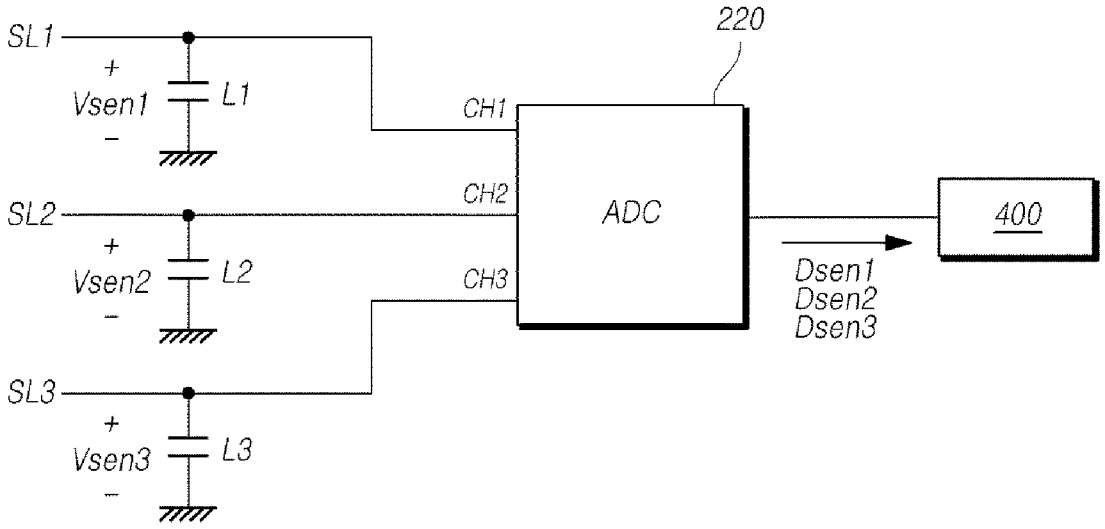
FIG. 5 is a diagram illustrating sensing and converting functions of an ADC in the display device according to an embodiment.

Meanwhile, referring to FIGS. 4 and 5, the three sensing lines SL1, SL2 and SL3 are connected to latches L1, L2 and L3, respectively. The latches L1, L2 and L3 store the sensing voltage Vsen of the sensing node in a corresponding sub-pixel. The above-mentioned latches L1, L2 and L3 may be implemented as a capacitor as shown in FIG. 4.

Referring to FIGS. 4 and 5, the ADC 220 converts voltages Vsen1, Vsen2 and Vsen3 sensed through the three sensing channels CH1, CH2 and CH3 into a digital type, and outputs converted sensing data Dsen1, Dsen2 and Dsen3 to store in a memory 400.

Referring to FIG. 4, as described above, the timing controller 140 reads all pieces of sensing data Dsen1, Dsen2, Dsen3, . . . which are sensed by the ADC 220 and stored in the memory 400, changes the data Data provided to the sub-pixel, and outputs the changed data Data' to the data driving integrated circuit 200.

Thus, the data driving integrated circuit 200 receives the changed data Data', converts the changed data Data' into the data voltage Vdata' of the analog type, and provides the data voltage Vdata' to a corresponding sub-pixel through an output buffer (not shown).

Meanwhile, while power of the display device 100 is turned on, a pixel compensation which compensates the mobility (μ) of the transistor in the sub-pixel may also be performed in real time.

Here, the pixel compensation which compensates the mobility (μ) of the transistor in each sub-pixel in real time when the power of the display device 100 is turned on is referred to as a Real Time (hereinafter, referred to as an RT) compensation.

For the above-mentioned RT compensation, the timing controller 140 may control to perform the pixel compensation (i.e., the RT compensation) which compensates the mobility (μ) of the transistor in each sub-pixel during a blank time on a vertical synchronous signal.

Meanwhile, the timing controller 140 may control to perform the pixel compensation which compensates the threshold voltage (Vth) of the transistor in each sub-pixel when a power off signal of the display device 100 is generated.

Here, when the power off signal of the display device 100 is generated, the pixel compensation which compensates the threshold voltage of the transistor in each sub-pixel is referred to as an OFF Real time Sensing (hereinafter, referred to as an OFF-RS).

Figure 6:
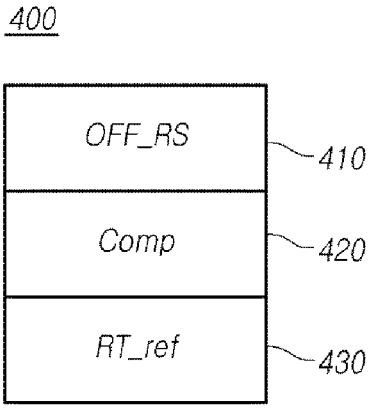
FIG. 6 illustrates an embodiment of a memory.

FIG. 6 illustrates an embodiment of a memory.

Referring to FIG. 6, the memory 400 may include a third memory area 430, a first memory area 410 and a second memory area 420. The third memory area 430 stores RT sensing data Dsen1, Dsen2 and Dsen3 to be used when a pixel compensation (e.g., the RT compensation) which compensates the mobility of the transistor in each sub-pixel. The first memory area 410 stores OFF-RS sensing data Dsen1, Dsen2 and Dsen3 to be used when a pixel compensation (e.g., the OFF-RS compensation) which compensates the threshold voltage of the transistor in each sub-pixel. The second memory area 420 stores initial sensing data to be used in compensating characteristic values (e.g., the threshold voltage (Vth), the mobility (μ) and the like) in the sub-pixel SP, and the compensation data Data' for the luminance compensation of a corresponding sub-pixel, which is converted from the data Data through the RT compensation (i.e., the mobility compensation) and the OFF-RS compensation (i.e., the threshold voltage compensation).

The first to third memory areas 410, 420 and 430 may store data in a look-up table. For example, the third memory area 430 may store the OFF-RS sensing data Dsen1, Dsen2 and Dsen3, in a first look-up table, which are to be used when the pixel compensation (e.g., the RT compensation) which compensates the mobility of the transistor in each sub-pixel.

Next, the data Data may be changed to the compensation data Data' for the luminance compensation of the corresponding sub-pixel through the RT compensation (i.e., the mobility compensation) and the OFF-RS compensation (the threshold voltage compensation).

As described above, when the power off signal of the display device 100 is generated, the OFF-RS compensation which compensates the threshold voltage of the transistor in each sub-pixel is performed. At this time, the display device 100 should design a power sequence so as to properly perform the OFF-RS compensation.

In the case of the normal OFF-RS compensation, when power of the display device 100 is turned off and an OFF-RS signal which controls to perform the OFF-RS is applied to the display device 100, as described with reference to FIGS. 3 and 4, the threshold voltages of each sub-pixel are sensed, the sensed voltages Vsen1, Vsen2 and Vsen3 are changed to a digital type, and the changed OFF-RS sensing data Dsen1, Dsen2 and Dsen3 are output to store the changed OFF-RS sensing data Dsen1, Dsen2 and Dsen3 in the first memory area 410 of the memory 400. At this time, previously stored OFF-RS sensing data Dsen1, Dsen2 and Dsen3 are deleted in the first memory area 410 of the memory 400.

At this time, in a case in which the power of the display device 100 is turned off abnormally, when the OFF-RS is not performed and the power of the display device 100 is turned on, the data Data may be changed to the compensation data Data' for the luminance compensation of the corresponding sub-pixel using the previously stored OFF-RS sensing data.

In addition, the OFF-RS may be performed abnormally according to a state of the display panel 110 or a circuit such as the data integrated circuit 120. At this time, there is not a method of determining whether the sensing data is an abnormal state. At this time, as described above, since the previous OFF-RS sensing data is deleted, there is not a method of recovering the state to a previous state when a problem is generated. Therefore, an abnormal driving problem may be generated according to a reliability problem, a circuit EMI or an FPGA driving bug.

In order to resolve such problems, the timing controller 140 performs the pixel compensation which changes the data Data provided to the corresponding sub-pixel based on the previous sensing data when the sensing data is abnormal.

Specifically, the timing controller 140 performs a backup on the previous OFF-RS sensing data in the second memory area 420 shown in FIG. 6. Next, the timing controller 140 determines whether the sensing data of each sub-pixel are abnormal. That is, the timing controller 140 determines whether the OFF-RS is normally operated using a result value (i.e., the sensing data) sensed during the OFF-RS operation.

In order to determine whether the sensing data is abnormal, a maximum threshold voltages of each sub-pixel and a maximum number of sub-pixels of which the threshold voltage is higher than the maximum threshold voltage are designated. The timing controller 140 records the number of the sub-pixels of which the sensing data is higher than the maximum threshold voltage. When the number of the sub-pixels of which the sensing data is higher than the maximum threshold voltage is higher than the maximum number, the timing controller 140 determines that the sensing data is abnormal or the OFF-RS is failed.

In order to determine whether the sensing data is abnormal, the timing controller 140 determines whether specifically written data rather than a compensation value generated by compensating the luminance of the corresponding sub-pixel is in the compensation data Data'. When the number of the specifically written data rather than the compensation value in the compensation data Data is higher than the designated maximum number, the timing controller 140 determines that the sensing data is abnormal or the OFF-RS is failed.

When the sensing data is abnormal, the timing controller 140 may change the data Data provided to the corresponding sub-pixel to the compensation data Data' for the luminance compensation of the corresponding sub-pixel, based on the previous sensing data. To this end, the timing controller 140 shifts the previous OFF-RS sensing data, which is backed up in the second memory area 420, to the first memory area 410. Therefore, when the power of the display device 100 is turned on, the timing controller 140 changes the data Data provided to the each sub-pixel to the compensation data Data' for the luminance compensation of the corresponding sub-pixel, based on the OFF-RS sensing data stored in the first memory area 410, which is the previous OFF-RS sensing data stored in the second memory area 420 and then shifted to the first memory area 410.

When the sensing data is normal, the timing controller 140 may change the data Data provided to the corresponding sub-pixel to the compensation data Data' for the luminance compensation of the corresponding sub-pixel based on the sensing data obtained in a corresponding OFF-RS operation. That is, when the power of the display device 100 is turned on, the timing controller 140 changes the data Data provided to each sub-pixel to the compensation data Data' for the luminance compensation of the corresponding sub-pixel based on the OFF-RS sensing data stored in the first memory area 410.

In the above-mentioned embodiment, when the sensing data is abnormal, the timing controller 140 shifts the previous OFF-RS sensing data backed up in the second memory area 420 to the first memory area 410, and when the power of the display device 100 is turned on, the timing controller 140 changes the data Data provided to each sub-pixel to the compensation data Data' for the luminance compensation of the corresponding sub-pixel, based on the previous OFF-RS sensing data which is stored in the second memory area 420 and then shifted to the first memory area 410, but the present invention is not limited thereto.

For example, when an external input such as a user input is input, except for the case of the abnormal sensing data, the timing controller 140 may shift the previous OFF-RS sensing data backed up in the second memory area 420 to the first memory area 410, and when the power of the display device 100 is turned on, the timing controller 140 may change the data Data provided to each sub-pixel to the compensation data Data' for the luminance compensation of the corresponding sub-pixel, based on the previous OFF-RS sensing data which is stored in the second memory area 420 and then shifted to the first memory area 410.

Figure 7:
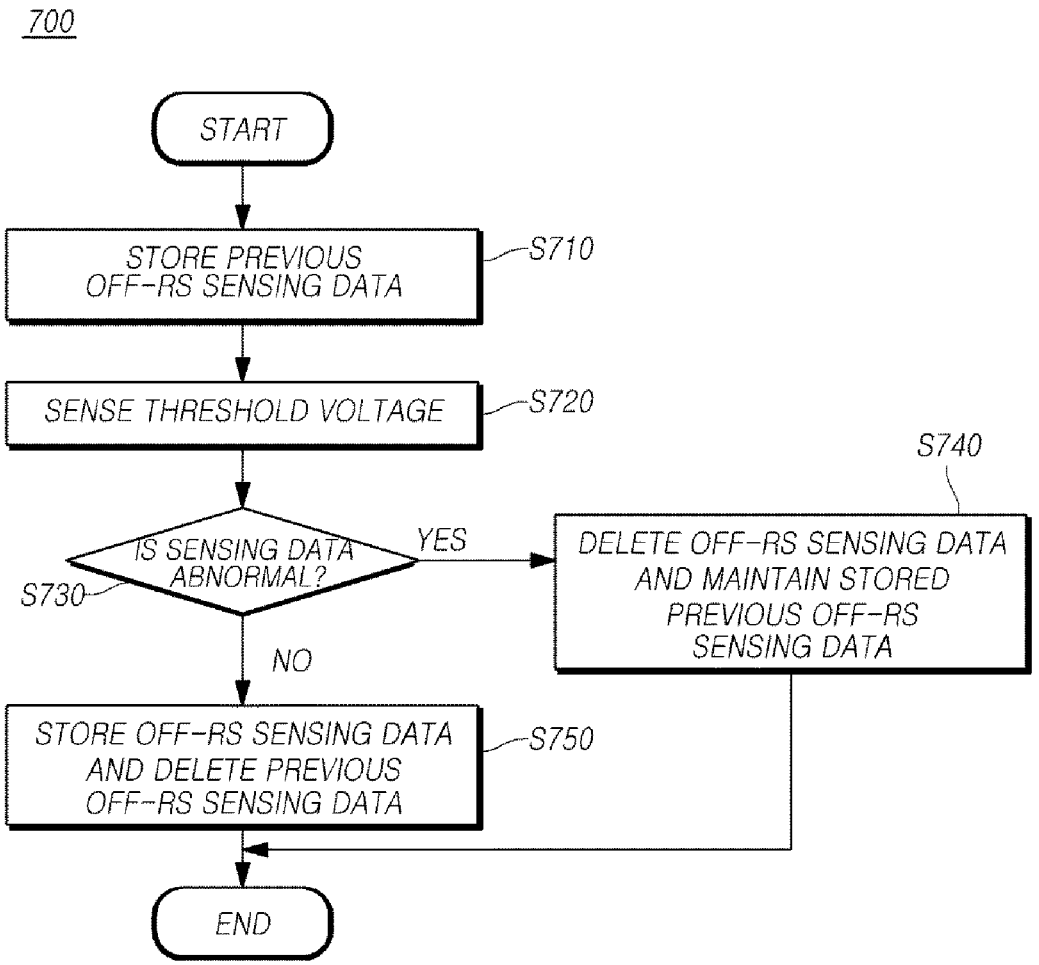
FIG. 7 is a flowchart illustrating a method of performing an OFF-RS compensation according to another embodiment.

FIG. 7 is a flowchart illustrating a method of performing the OFF-RS compensation according to another embodiment.

Referring to FIG. 7, the method of performing the OFF-RS according to another embodiment includes storing the previous OFF-RS sensing data (S710), sensing the threshold voltage (S720), determining whether the sensing data is abnormal (S730), when the sensing data is abnormal, deleting the OFF-RS sensing data and maintaining the stored previous OFF-RS sensing data (S740), and when the sensing data is normal, storing the OFF-RS sensing data and deleting the previous OFF-RS sensing data (S750).

Figure 8:
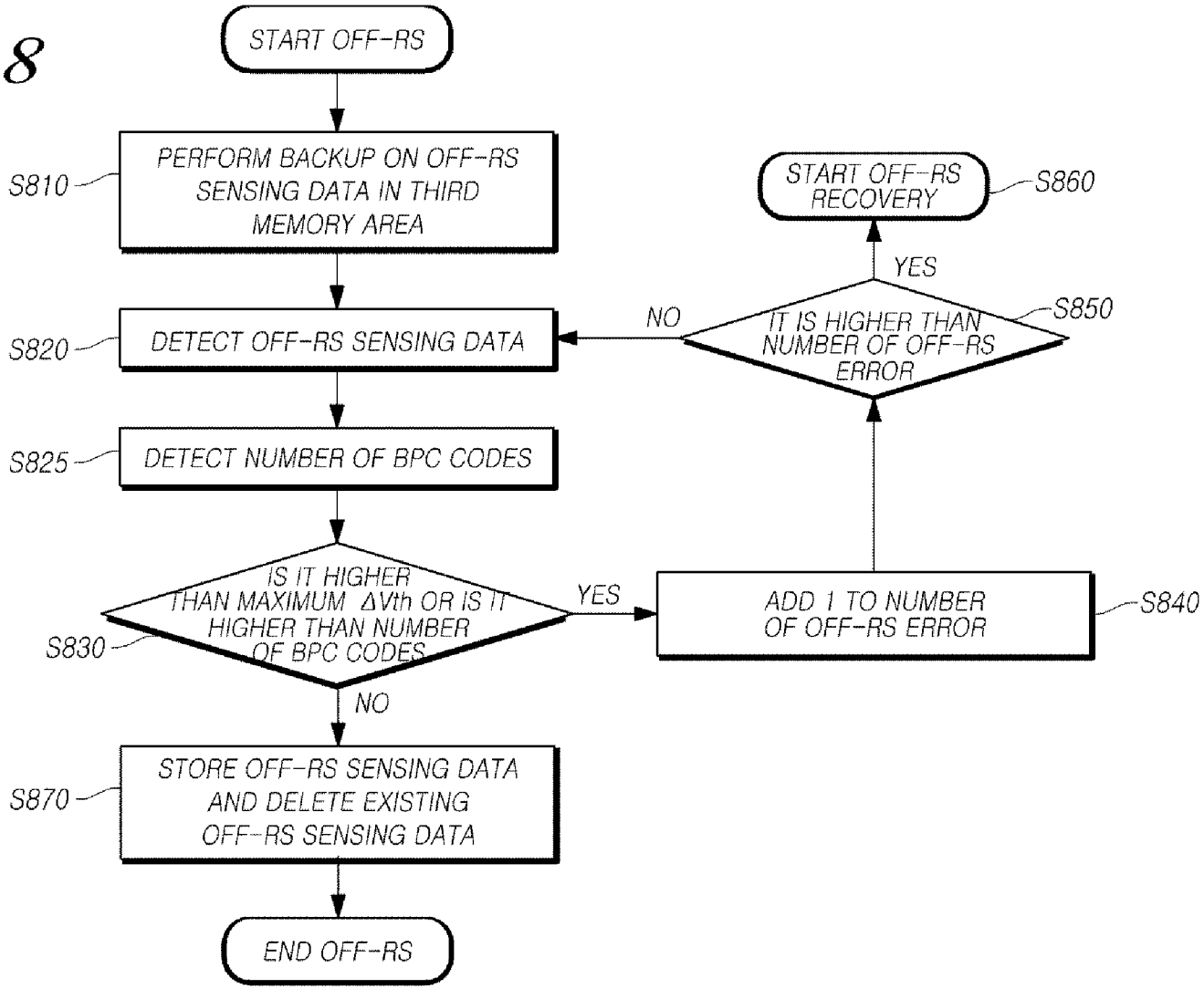
FIGS. 8 and 9 are flowcharts illustrating the specified method of performing the OFF-RS according to another embodiment of FIG. 7.
Figure 9:
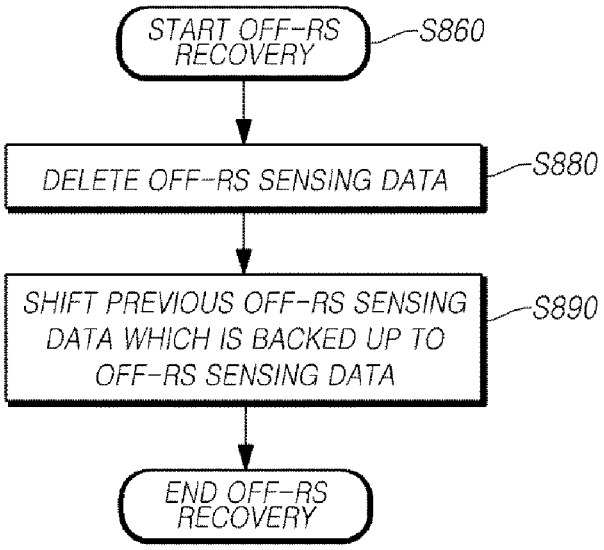

FIGS. 8 and 9 are flowcharts illustrating the specified method of performing the OFF-RS according to another embodiment of FIG. 7.

Referring to FIG. 8, first, the previous OFF-RS sensing data is backed up in the second memory area 420 shown in FIG. 6 (S810).

Next, the OFF-RS sensing data is detected through the ADC 220 (S820).

Next, in order to determine whether the specifically written data rather than the compensation value generated by compensating the luminance of the corresponding sub-pixel is in the compensation data Data', the number of a generation of a BPC code which is a code displayed in the compensation data (S825).

Next, in order to determine whether the sensing data is abnormal, it is determined whether the number of the sub-pixels of which the sensing data is higher than the maximum threshold voltage of each sub-pixel is higher than the maximum number when the OFF-RS is performed or the number of the generation of the BPC is higher than a designated maximum BPC code generation number (S830).

If, in step 830, it is determined that the number of the sub-pixels of which the sensing data is higher than the maximum threshold voltage of each sub-pixel is higher than the maximum number when the OFF-RS is performed or the number of the generation of the BPC is higher than the designated maximum BPC code generation number, one is added to an OFF-RS error number (S840). It is determined that the OFF-RS error number is higher than a maximum OFF-RS error number (S850). That is, in step 850, the sensing data is abnormal or the OFF-RS is failed. For example, the maximum OFF-RS error number may be one or two, but is not limited thereto.

If, in step 850, it is determined that the OFF-RS error number is higher than the maximum OFF-RS error number (i.e., it is determined that the sensing data is abnormal or the OFF-RS is failed), an OFF-RS recovery is started (S860).

In step 830, if it is determined that the number of the sub-pixels of which the sensing data is higher than the maximum threshold voltage of each sub-pixel is not higher than the maximum number when the OFF-RS is performed or the number of the generation of the BPC is not higher than the designated maximum BPC code generation number (i.e., it is determined that the sensing data is normal or the OFF-RS is succeeded), the OFF-RS sensing data is stored in the first memory area 410 of the memory 400, and the existing OFF-RS sensing data backed up in the second memory area 420 is deleted (S870).

Referring to FIG. 9, when the OFF-RS recovery is started, the OFF-RS sensing data stored in the first memory area 410 is deleted, and the previous OFF-RS sensing data stored in the second memory area 420 is shifted to the first memory area 410 (S880).

When the power of the display device 100 is turned on regardless of the normal or abnormal of the sensing data or the success or fail of the OFF-RS, the timing controller 140 changes the data Data provided to the each sub-pixel to the compensation data Data' for the luminance compensation of the corresponding sub-pixel, based on the OFF-RS sensing data stored in the first memory area 410.

According to the above-mentioned embodiment, when the OFF-RS pixel compensation is performed, a problem may be detected in advance and the OFF-RS pixel compensation may be performed again. In addition, according to the above-mentioned embodiment, when the OFF-RS pixel compensation is normally performed but there is a problem on a screen, the data may be compensated based on the previous sensing data.

As shown in FIG. 6, the memory 400 includes the first memory area 410 storing the OFF-RS sensing data Dsen1, Dsen2 and Dsen3, the third memory area 430 storing the RT sensing data Dsen1, Dsen3 and Dsen3, and the second memory area 420 storing the initial sensing data or the compensation data Data'.

At this time, the second memory area 420 is not corrected, and only the OFF-RS sensing data is updated in the case of the OFF-RS compensation. However, as described with reference to FIGS. 7 to 9, when the OFF-RS sensing data is abnormal or the OFF-RS is failed, the OFF-RS sensing data may be deleted. Even though, the OFF-RS sensing data is deleted, since the sensing data or the compensation data stored in the second memory area 420 is the initial sensing data or the compensation data, the sensing data or the compensation data stored in the second memory area 420 cannot reflect a change of a characteristic value of the transistor.

There is a problem in which an image is corrupted after the OFF-RS operation as one among many defects of the display panel 110. In most cases, the OFF-RS is deleted and then the OFF-RS operation is performed again, and the screen is recovered normally.

Thus, when the image is corrupted and thus the problem on the screen is generated, a function capable of deleting recent OFF-RS data and recovering the image is provided.

Figure 10A:
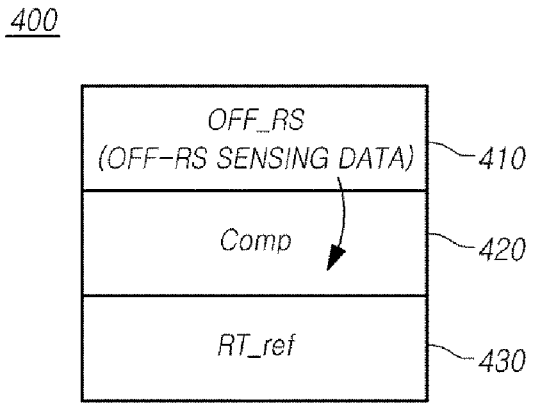
FIGS. 10A, 10B and 10C illustrate processes of deleting recent OFF-RS data and recovering an image when the image is corrupted and thus a problem is generated in a screen.
Figure 10B:
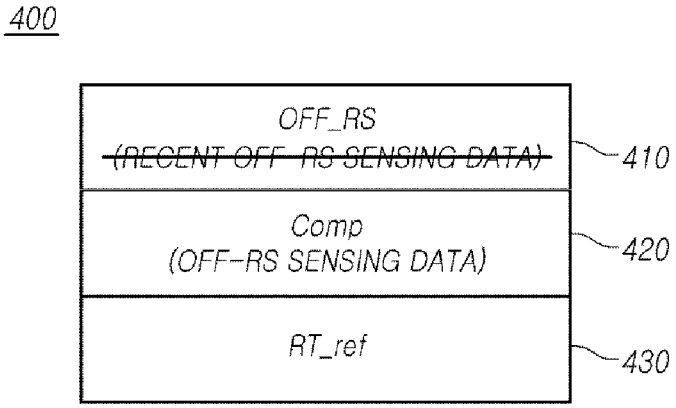
Figure 10C:
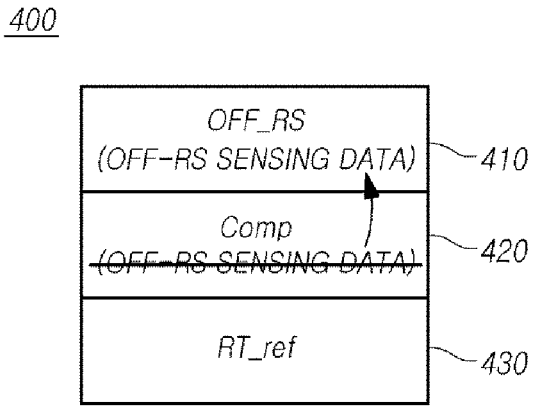

FIGS. 10A, 10B and 10C illustrate processes of deleting the recent OFF-RS data and recovering the image when the image is corrupted and thus the problem is generated in the screen.

The timing controller 140 stores the existing OFF-RS sensing data, which is stored in the first memory area 410, in the second memory area 420 when the timing controller 140 performs the OFF-RS compensation as shown in FIG. 10A.

When the timing controller 140 receives a signal for deleting the OFF-RS sensing data from an external host system, the timing controller 140 deletes the recent OFF-RS sensing data stored in the first memory area 410 as shown in FIG. 10B. At this time, when a button for deleting the OFF-RS sensing data, which is included in the display device 100 or electronics including the display device 100 is pushed, the external host system provides the signal for deleting the OFF-RS sensing data to the timing controller 140 through a specific interface, for example, an I2C. The electronics according to the present embodiment means electronics including the display device 100 such as a television system, a home theater system, a set-top box, a navigation system, a DVD player, a Blu-ray player, a Personal Computer (PC), a phone system, a notebook computer, a monitor and the like.

The timing controller 140 shifts the previous OFF-RS sensing data, which is stored in the second memory area 420, to the first memory area 410 as shown in FIG. 10C. Accordingly, the OFF-RS sensing data is stored in the first memory area 410, but the previous OFF-RS sensing data rather than the recent OFF-RS sensing data is stored. Therefore, when the next power of the display device 100 is turned on, the timing controller 140 changes the data Data of each sub-pixel to the compensation data Data' based on the OFF-RS sensing data stored in the first memory area 410.

When the OFF-RS is failed, the data Data of each sub-pixel is changed to the compensation data Data' based on the previous OFF-RS sensing data using the memory structure shown in FIGS. 10A to 10C, and thus the existing memory structure may be utilized.

FIGS. 11A to 11D illustrate a memory according to another embodiment.

Referring to FIG. 11A to 11D, a configuration of the memory 400 including a first memory area 1010 storing the OFF-RS sensing data Dsen1, Dsen2 and Dsen3, a third memory area 1030 storing the RT sensing data Dsen1, Dsen2 and Dsen3, and a second memory area 1020 storing the initial sensing data or the compensation data Data' is the same as the configuration of the memory 400 shown in FIG. 6. In the memory 400 shown in FIG. 11A to 11D, the first memory area 1010 (shown in FIG. 11A) storing the OFF-RS sensing data Dsen1, Dsen2 and Dsen3 is divided into two memory areas 1010*a* and 1010*b*.

Figure 11A:
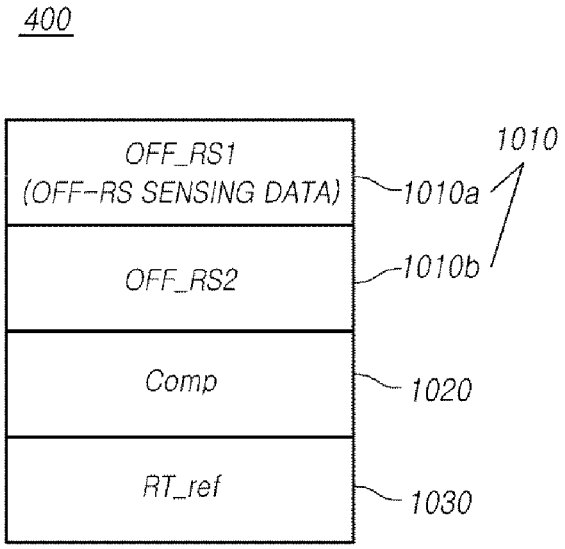
Figure 11D:
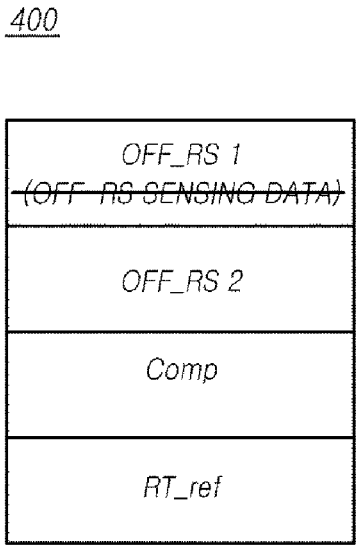

The timing controller 140 stores the sensing data in the memory area 1010*a* of two memory areas 1010*a* and 1010*b* in the first memory area 1010 when the timing controller 140 performs the OFF-RS compensation as shown in FIG. 11A. When the timing controller 140 performs the next OFF-RS compensation, the timing controller 140 stores the sensing data in the memory area 1010*b* of two memory areas 1010*a* and 1010*b* in the first memory area 1010 and deletes the previous sensing data from the memory area 1010*a* as shown in FIG. 11B.

When the timing controller 140 performs the OFF-RS compensation, the timing controller 140 stores the existing OFF-RS sensing data, which is stored in the first memory area 1010*b*, in the second memory area 420 as shown in FIG. 11C.

When the timing controller 140 receives the signal for deleting the OFF-RS sensing data from the external host system, the timing controller 140 deletes the recent OFF-RS sensing data stored in the first memory area 1010*a* as shown in FIG. 10C. At this time, when the button for deleting the OFF-RS sensing data, which is included in the display device 100 or the electronics including the display device 100 is pushed, the external host system provides the signal for deleting the OFF-RS sensing data to the timing controller 140 through a specific interface, for example, an I2C.

The timing controller 140 shifts the previous OFF-RS sensing data, which is stored in the second memory area 1020, to the memory area 1010*a* of the first memory area 1010 as shown in FIG. 10D. Accordingly, the OFF-RS sensing data is stored in the memory area 1010*a* of the first memory area 1010, but the previous OFF-RS sensing data rather than the recent OFF-RS sensing data is stored. Therefore, when next power of the display device 100 is turned on, the timing controller 140 changes the data Data of each sub-pixel to the compensation data Data' based on the OFF-RS sensing data stored in the memory area 1010*a* of the first memory area 1010.

When the recent OFF-RS sensing data should be stored in the memory area 1010*b* of the first memory area 1010, the timing controller 140 deletes the recent OFF-RS sensing data stored in the memory area 1010*b* of the first memory area 1010 and shifts the existing OFF-RS sensing data, which is stored in the second memory area 1020, to the first memory area 1010*b* of the first memory area 1010.

When next power of the display device 100 is turned on, the timing controller 140 changes the data Data of each sub-pixel to the compensation data Data' based on the OFF-RS sensing data stored in the memory area 1010*b* of the first memory area 1010.

When the OFF-RS operation is performed as described above, since the recent OFF-RS sensing data is deleted, the previous OFF-RS sensing data is stored and the data of each sub-pixel is compensated, the problem generated during the OFF-RS is removed. Especially, a user or an electronics manufacturing company may resolve the problem generated during the OFF-RS operation.

Figure 12:
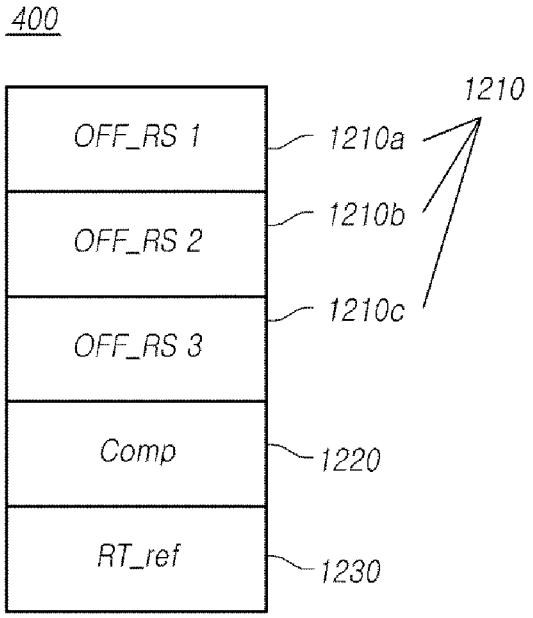
FIG. 12 illustrates a memory according to another embodiment.

FIG. 12 illustrates a memory according to another embodiment.

Referring to FIG. 12, a configuration of the memory 400 including a first memory area 1210 storing the OFF-RS sensing data Dsen1, Dsen2 and Dsen3, a third memory area 1230 storing the RT sensing data Dsen1, Dsen2 and Dsen3, and a second memory area 1220 storing the initial sensing data or the compensation data Data' is the same as the configuration of the memory 400 shown in FIG. 11A to 11D. In the memory 400 shown in FIG. 12, a first memory area 1010 storing the sensing data Dsen1, Dsen2 and Dsen3 is divided into three memory areas 1010*a*, 1010*b* and 1010*c*.

The timing controller 140 performs a backup on the previous OFF-RS sensing data in the second memory area 1220 using the memory structure shown in FIG. 11A to 11D. However, when the memory structure shown in FIG. 12 is used, the timing controller 140 stores the previous OFF-RS sensing data in the memory area 1210*c* of the first memory area, in the case of the OFF-RS defect, for example the single OFF-RS defect, the timing controller 140 deletes the recent OFF-RS sensing data stored in one of two first memory areas 1210*a* and 1210*b* and shifts the previous OFF-RS sensing data stored in the memory area 1210*c* of the first memory area to a corresponding first memory area.

Through this, a disuse cost of the display device due to a single OFF-RS defect may be reduced, the initial sensing data or the compensation data stored in the second memory area 1220 may not be deleted when the recent OFF-RS sensing data is deleted, and an image change problem due to a threshold voltage movement may be resolved using the backed up OFF-RS sensing data in the case of the single OFF-RS defect.

In the above embodiments, the memory 400 is configured separately from the timing controller 140, but the present invention is not limited thereto.

Figure 13:
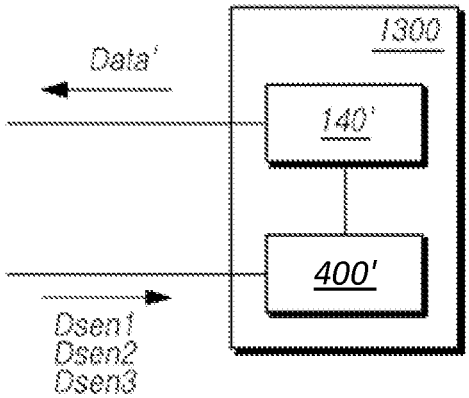
FIG. 13 is a configuration view of a data driving unit and a control device of a display device according to another embodiment.

FIG. 13 is a configuration view of a data driving unit and a control device of a display device according to another embodiment.

Referring to FIG. 13, a control device 1300 includes a timing controller 140' and a memory 400'. The control device 1300 may be implemented as one integrated circuit.

The timing controller 140' is substantially the same as the timing controller 140 which compensates data based on the sensing data stored in the memory 400 in the above-mentioned embodiments.

The memory 400' is substantially the same as the memory 400 described above with reference to FIGS. 6 and 10A to 10C, 11A to 11D, and 12.

In the above embodiments, the data Data provided to the corresponding sub-pixel is changed based on the OFF-RS sensing data, and when the OFF-RS sensing data is abnormal, the OFF-RS compensation which changes the data Data provided to the corresponding sub-pixel is changed based on the previous OFF-RS sensing data is performed, but the present invention is not limited thereto. The present invention may perform the RT compensation which changes the data Data provided to the corresponding sub-pixel based on the RT sensing data and changes the data Data provided to the corresponding sub-pixel based on the previous RT sensing data when the RT sensing data is abnormal.

At this time, the RT sensing data may be stored in the second memory area 420 and the previous RT sensing data may be shifted to the third memory area 430 when the RT sensing data is abnormal, in the same manner as the case in which the OFF-RS sensing data is stored in the second memory area 420 and the previous OFF-RS sensing data is shifted to the first memory area 410 when the OFF-RS sensing data is abnormal in FIG. 10A to 10C.

In FIGS. 11A to 11D and 12, first memory areas 1010 and 1230 are respectively divided into two and three memory areas, and in the same manner, third memory areas 1030 and 1230 may also be divided into two and three memory areas.

According to the above-mentioned embodiment, a problem generated in the case of the pixel compensation may be detected in advance and the pixel compensation may be performed again.

In addition, according to the above-mentioned embodiment, when the pixel compensation is normally performed but a problem on a screen is generated, the data may be compensated based on the previous sensing data.

The above description and the accompanying drawings provide an example of the technical idea of the present invention for illustrative purposes only. Those having ordinary knowledge in the technical field, to which the present invention pertains, will appreciate that various modifications and changes in form, such as combination, separation, substitution, and change of a configuration, are possible without departing from the essential features of the present invention. Therefore, the embodiments disclosed in the present invention are intended to illustrate the scope of the technical idea of the present invention, and the scope of the present invention is not limited by the embodiment. The scope of the present invention shall be construed on the basis of the accompanying claims in such a manner that all of the technical ideas included within the scope equivalent to the claims belong to the present invention.

What is claimed is:

1. A display device comprising: a display panel including data lines, gate lines, a sub-pixel formed in every point where the gate lines and the data lines cross, and a sensing line formed in every sub-pixel row or every two or more sub-pixel rows, the sensing line being connected to a circuit in the sub-pixel row;

a data driving unit that provides a data voltage to the data lines;

an Analog Digital Converter (ADC) that converts a sensing voltage measured through a sensing channel corresponding to each sensing line into sensing data of a digital type;

a memory including a first memory area storing the sensing data of each sub-pixel and a second memory area storing initial sensing data or compensation data of each sub-pixel; and a timing controller that controls the data driving unit, and performs a pixel compensation which changes data provided to a corresponding sub-pixel based on the sensing data in the first memory area, wherein the timing controller performs a backup on a previous sensing data in the second memory area in the case of the pixel compensation, wherein the sensing data is abnormal when the number of the sensing data of each sub-pixel is higher than a maximum number of the sub-pixels of which voltages are higher than a maximum threshold voltage or when specifically written data rather than a compensation value is in compensation data, and wherein when the sensing data is abnormal the timing controller performs the pixel compensation which shifts the previous sensing data stored in the second memory area to the first memory area and changes the data provided to the corresponding sub-pixel based on the previous sensing data shifted to the first memory area.

2. The display device of claim 1, wherein, when a power off signal of the display device is generated, the timing controller controls to perform the pixel compensation which compensates a threshold voltage of a transistor in each sub-pixel.

3. The display device of claim 1 wherein the timing controller performs a backup on the previous sensing data in the second memory area when a signal is received from an external host system.

4. The display device of claim 1, wherein the first memory area is divided into two memory areas, and the two memory areas sequentially store recent sensing data in every pixel compensation.

5. The display device of claim 1 wherein the first memory area divided into three memory areas storing the sensing data of each sub-pixel, wherein the timing controller sequentially stores recent sensing data in two memory areas among three memory areas of the first memory area in every pixel compensation, performs a backup on the previous sensing data in one among three memory areas of the first memory area, and when the sensing data is abnormal, the timing controller performs the pixel compensation which shifts the previous sensing data stored in one among three memory areas of the first memory area to one of two memory areas of the first memory and changes the data provided to the corresponding sub-pixel based on the sensing data stored in one of two memory areas of the first memory area.

6. A control device comprising:

a timing controller that controls a data driving unit, and performs a pixel compensation which changes data provided to a corresponding sub-pixel based on sensing data; and a memory that stores the sensing data, wherein the memory includes a first memory area storing the sensing data of each sub-pixel and a second memory area storing initial sensing data or compensation data of each sub-pixel and the timing controller performs a backup on the previous sensing data in the second memory area in the case of the pixel compensation, and when the sensing data is abnormal, the timing controller performs the pixel compensation which shifts the previous sensing data stored in the second memory area to the first memory area and changes the data provided to the corresponding sub-pixel based on the previous sensing data shifted to the first memory area, and wherein the sensing data is abnormal when the number of the sensing data of each sub-pixel is higher than a maximum number of the sub-pixels of which voltages are higher than a maximum threshold voltage or when specifically written data rather than a compensation value is in compensation data.

7. The control device of claim 6, wherein, when a power off signal of a display device is generated, the timing controller controls to perform the pixel compensation which compensates a threshold voltage of a transistor in each sub-pixel.

8. The control device of claim 7, wherein the timing controller performs a backup on the previous sensing data in the second memory area when a signal is received from an external host system.

9. The control device of claim 6, wherein the first memory area is divided into two memory areas, and the two memory areas sequentially store recent sensing data in every pixel compensation.

10. The control device of claim 6, wherein the timing controller sequentially stores recent sensing data in two memory areas among three memory areas of the first memory area in every pixel compensation, performs a backup on the previous sensing data in one among three memory areas of the first memory area, and when the sensing data is abnormal, the timing controller performs the pixel compensation which shifts the previous sensing data stored in one among three memory areas of the first memory area to one of two memory areas of the first memory and changes the data provided to the corresponding sub-pixel based on the sensing data stored in one of two memory areas of the first memory area.

* * * * *